US005526539A

United States Patent [19]

Bower et al.

[11] Patent Number: 5,526,539

[45] Date of Patent: Jun. 18, 1996

[54] PORTABLE WASHING CART

[76] Inventors: Lori J. Bower; Dennis L. Bower, both of 2308 Henryville Bluelick Rd., Henryville, Ind. 47126; Lois A. Monroe; William W. Monroe, both of 115 E. Harrison Ave., Clarksville, Ind. 47129

[21] Appl. No.: 409,431

[22] Filed: Mar. 24, 1995

[51] Int. Cl.[6] ..... A45D 19/04

[52] U.S. Cl. ..... 4/516; 4/519; 4/619; 312/317.3

[58] Field of Search ..... 4/515–519, 523, 4/619; 312/290, 317.1, 317.3

[56] References Cited

U.S. PATENT DOCUMENTS

| | | | |
|---|---|---|---|
| 3,010,775 | 11/1961 | Giovanelli | 312/290 X |
| 3,041,957 | 7/1962 | Liptay | 4/516 X |
| 3,087,767 | 4/1963 | Schell | 312/290 X |
| 4,821,347 | 4/1989 | Nash | 4/516 |
| 4,998,302 | 3/1991 | Silva | 4/516 |

FOREIGN PATENT DOCUMENTS

| | | | |
|---|---|---|---|
| 0721891 | 11/1965 | Canada | 4/516 |
| 1309939 | 10/1961 | France | 4/516 |

*Primary Examiner*—Charles E. Phillips

[57] ABSTRACT

A portable washing cart for facilitating washing of hair at a remote location. The inventive device includes a wheeled main body having a plurality of pivotally mounted doors. An interior counter top is mounted within the main body and includes a fixed sink mounted relative to the counter top and a movable sink removably mounted relative to the counter top which can be extended therefrom for placement proximal to a head of an individual residing within an adjacent support structure. A water handling assembly is mounted within the main body for supplying water to the sinks and for collecting waste water drained therefrom such that shampooing of the hair of an individual residing within a bed can be accomplished without moving the individual from the bed.

11 Claims, 3 Drawing Sheets

FIG 1
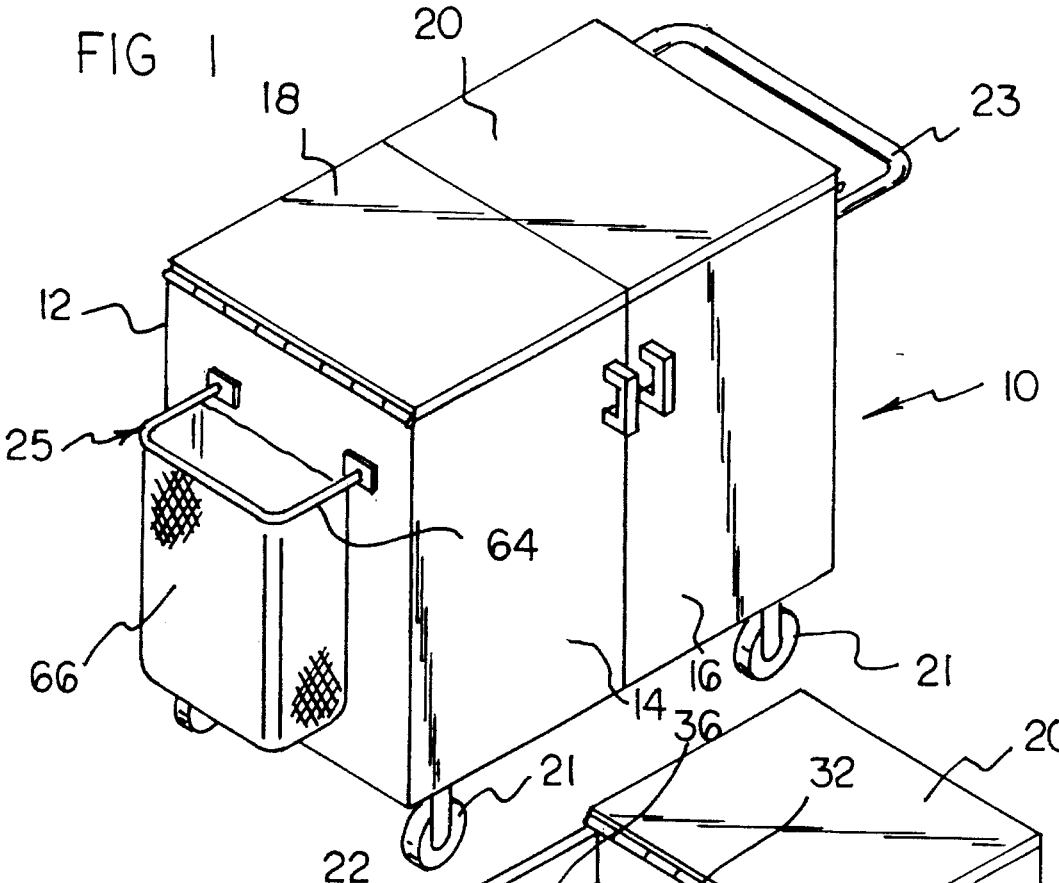
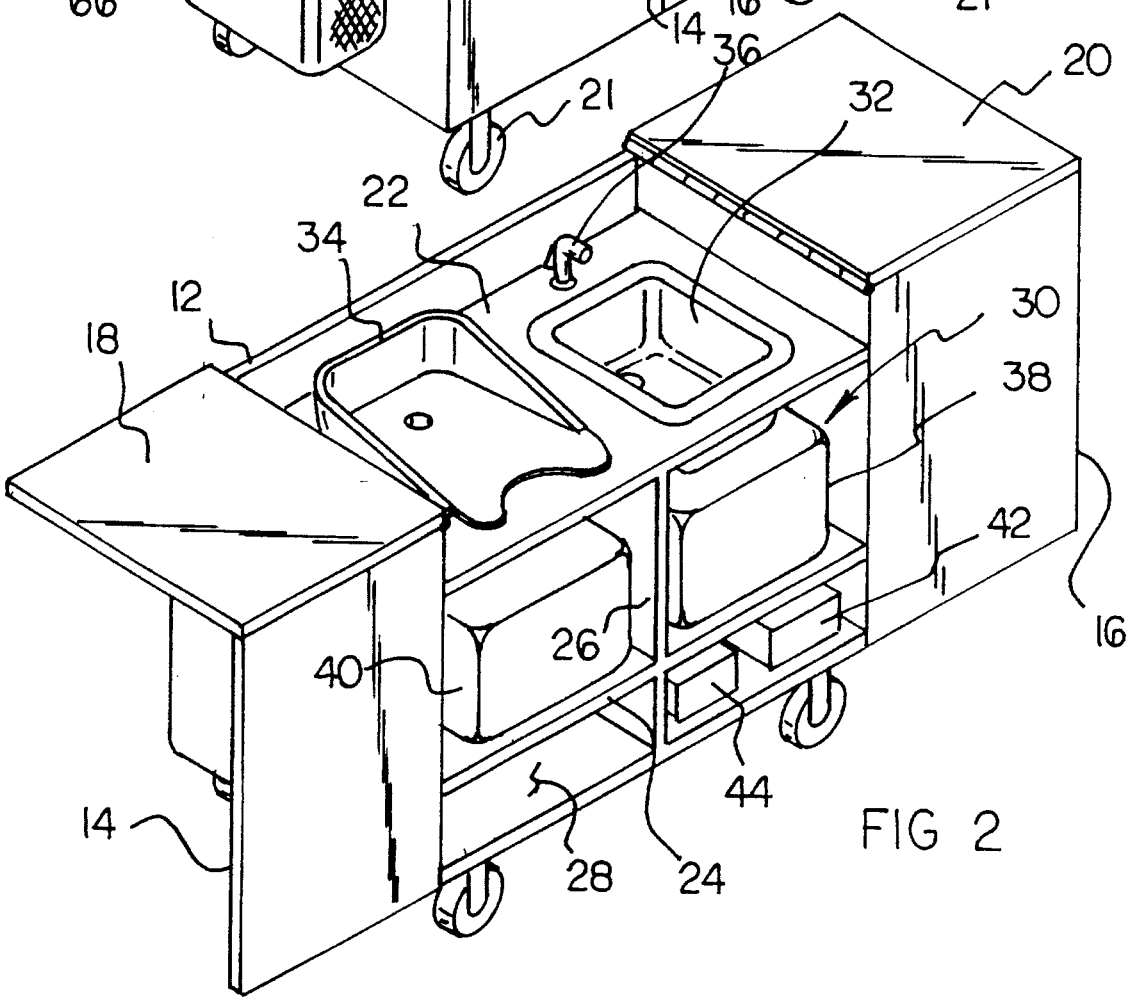
FIG 2

FIG 3
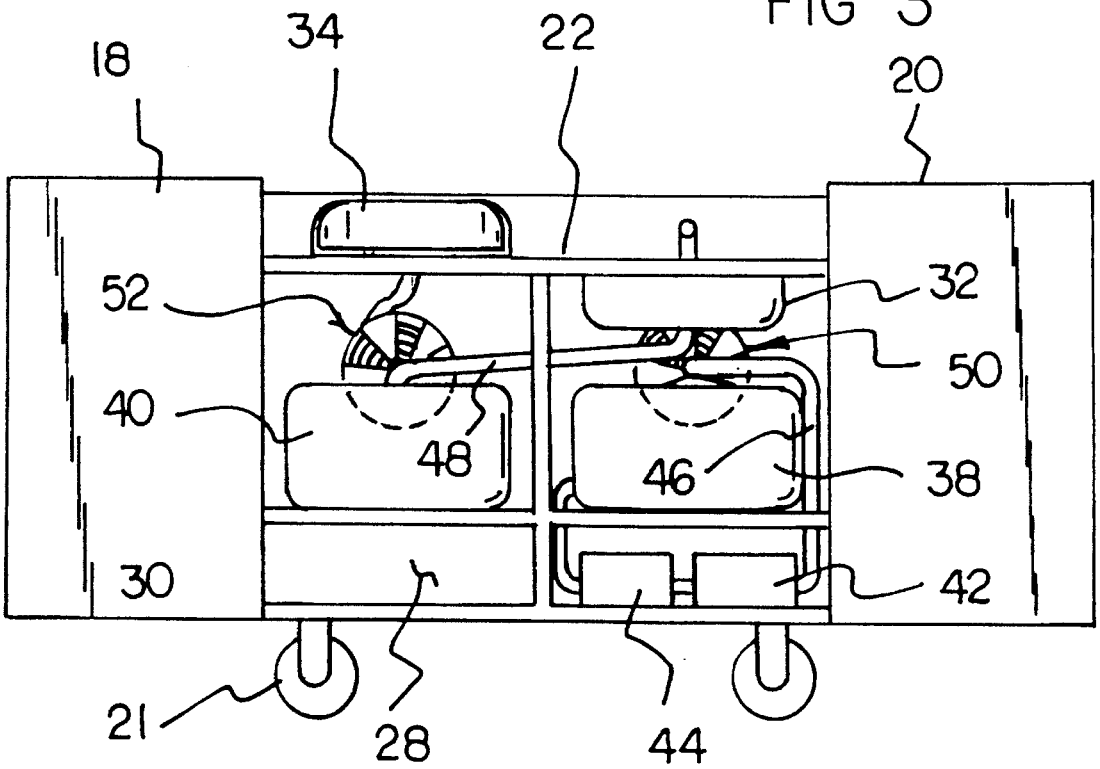
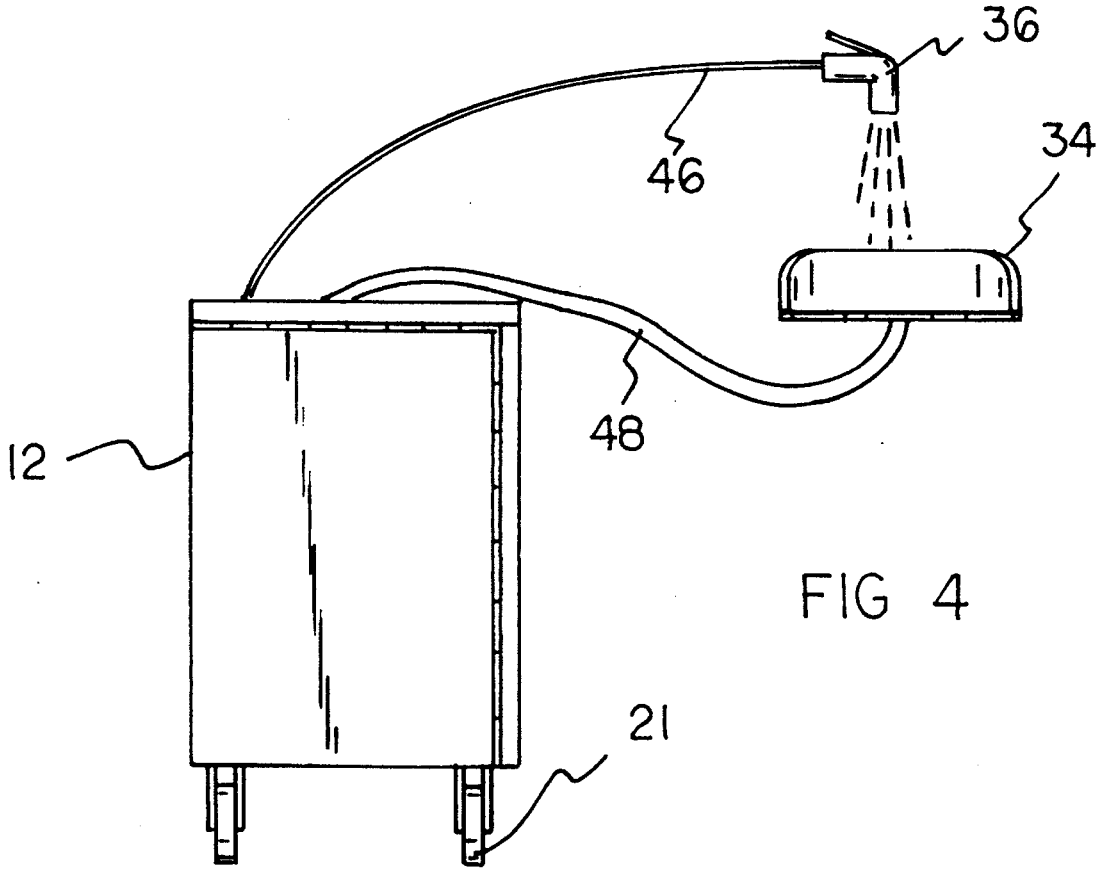
FIG 4

FIG 5
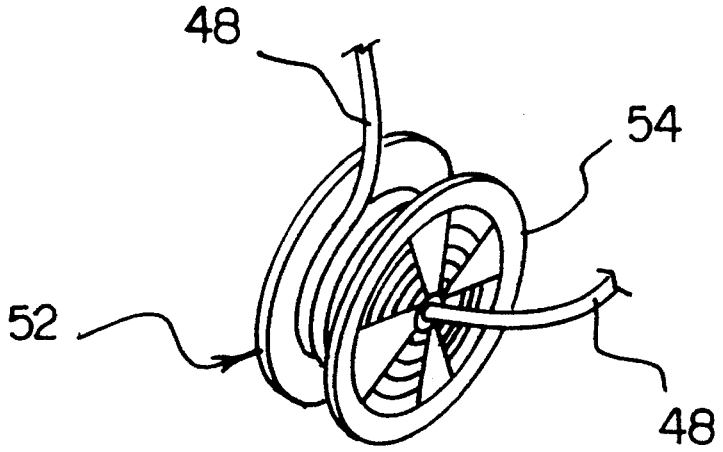
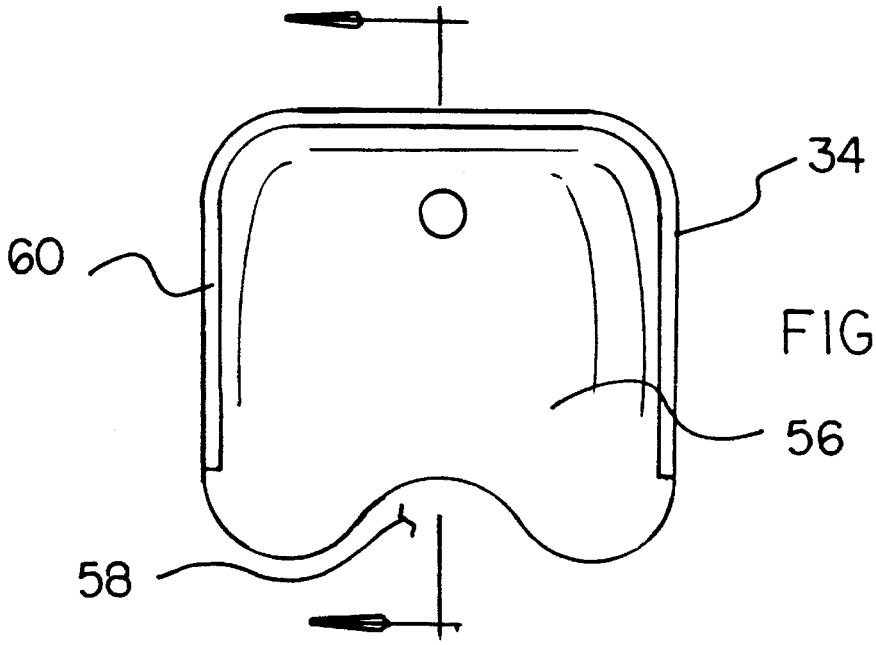
FIG 6
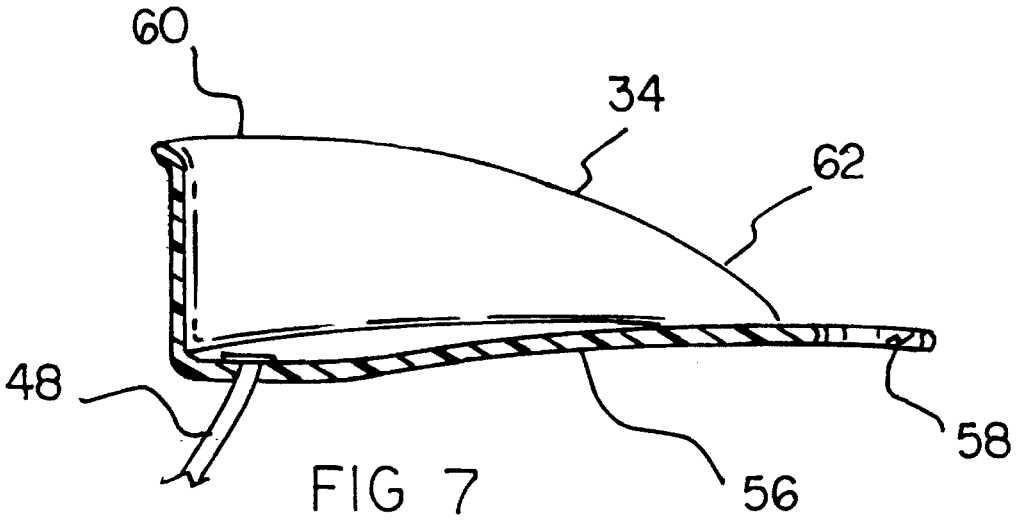
FIG 7

PORTABLE WASHING CART

BACKGROUND OF THE INVENTION

1. Field of the Invention

The present invention relates to portable fluid supply devices and more particularly pertains to a portable washing cart for facilitating washing of hair at a remote location.

2. Description of the Prior Art

The use of portable fluid supply devices is known in the prior art. More specifically, portable fluid supply devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art portable fluid supply devices include U.S. Pat. No. 4,821,348; U.S. Pat. No. 5,305,481; U.S. Pat. No. 4,574,407; and U.S. Pat. No. 4,795,179.

While these devices fulfill their respective, particular objectives and requirements, the aforementioned patents do not disclose a portable washing cart for facilitating washing of hair at a remote location which includes a wheeled main body having a plurality of pivotally mounted doors, an interior counter top mounted within the main body and including a fixed sink mounted relative to the counter top and a movable sink removably mounted relative to the counter top which can be extended therefrom for placement proximal to a head of an individual residing within an adjacent support structure, and a water handling assembly mounted within the main body for supplying water to the sinks and for collecting waste water drained therefrom such that shampooing of the hair of an individual residing within a bed can be accomplished without moving the individual from the bed.

In these respects, the portable washing cart according to the present invention substantially departs from the conventional concepts and designs of the prior art, and in so doing provides an apparatus primarily developed for the purpose of facilitating washing of hair at a remote location.

SUMMARY OF THE INVENTION

In view of the foregoing disadvantages inherent in the known types of portable fluid supply devices now present in the prior art, the present invention provides a new portable washing cart construction wherein the same can be utilized for facilitating washing of hair at a remote location. As such, the general purpose of the present invention, which will be described subsequently in greater detail, is to provide a new portable washing cart apparatus and method which has many of the advantages of the portable fluid supply devices mentioned heretofore and many novel features that result in a portable washing cart which is not anticipated, rendered obvious, suggested, or even implied by any of the prior art portable fluid supply devices, either alone or in any combination thereof.

To attain this, the present invention generally comprises a portable washing cart for facilitating washing of hair at a remote location. The inventive device includes a wheeled main body having a plurality of pivotally mounted doors. An interior counter top is mounted within the main body and includes a fixed sink mounted relative to the counter top and a movable sink removably mounted relative to the counter top which can be extended therefrom for placement proximal to a head of an individual residing within an adjacent support structure. A water handling assembly is mounted within the main body for supplying water to the sinks and for collecting waste water drained therefrom such that shampooing of the hair of an individual residing within a bed can be accomplished without moving the individual from the bed.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable washing cart apparatus and method which has many of the advantages of the portable fluid supply devices mentioned heretofore and many novel features that result in a portable washing cart which is not anticipated, rendered obvious, suggested, or even implied by any of the prior art portable fluid supply devices, either alone or in any combination thereof.

It is another object of the present invention to provide a new portable washing cart which may be easily and efficiently manufactured and marketed.

It is a further object of the present invention to provide a new portable washing cart which is of a durable and reliable construction.

An even further object of the present invention is to provide a new portable washing cart which is susceptible of a low cost of manufacture with regard to both materials and labor, and which accordingly is then susceptible of low prices of sale to the consuming public, thereby making such portable washing carts economically available to the buying public.

Still yet another object of the present invention is to provide a new portable washing cart which provides in the apparatuses and methods of the prior art some of the advantages thereof, while simultaneously overcoming some of the disadvantages normally associated therewith.

Still another object of the present invention is to provide a new portable washing cart for facilitating washing of hair at a remote location.

Yet another object of the present invention is to provide a new portable washing cart which includes a wheeled main body having a plurality of pivotally mounted doors, an interior counter top mounted within the main body and including a fixed sink mounted relative to the counter top and a movable sink removably mounted relative to the counter top which can be extended therefrom for placement proximal to a head of an individual residing within an adjacent support structure, and a water handling assembly mounted within the main body for supplying water to the sinks and for collecting waste water drained therefrom such that shampooing of the hair of an individual residing within a bed can be accomplished without moving the individual from the bed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a portable washing cart according to the present invention.

FIG. 2 is an isometric illustration of the present invention in an open configuration.

FIG. 3 is a front elevational view of the invention in the open configuration.

FIG. 4 is a side elevational view of the invention with portions thereof in an extended position.

FIG. 5 is an isometric illustration of a conduit reel of the invention.

FIG. 6 is a top plan view of a movable sink comprising a portion of the present invention.

FIG. 7 is a cross sectional view taken along line 7—7 of FIG. 6.

DESCRIPTION OF THE PREFERRED EMBODIMENT

With reference now to the drawings, and in particular to FIGS. 1–7 thereof, a new portable washing cart embodying the principles and concepts of the present invention and generally designated by the reference numeral 10 will be described.

More specifically, it will be noted that the portable washing cart 10 comprises a main body 12 having a hollow interior enclosed by a left front door 14 pivotally mounted to a left vertical edge of the main body and a right front door 16 pivotally mounted to a right vertical edge of the main body, as shown in FIG. 1 of the drawings. A left top door 18 is pivotally mounted to a left horizontal edge of the main body, with a right top door 20 being similarly pivotally mounted to a right horizontal edge of the main body. As shown in FIG. 2, the doors 14–20 can be opened to facilitate or permit access into the interior of the main body. Preferably, the top doors 18 and 20 engage upper edges of the front doors 14 and 16 when opened so as to be supported in a substantially horizontal orientation to permit use of the top doors as a support surface or counter. If desired, wheels or casters 21 can be rotatably mounted to the main body 12 to facilitate rolling movement of the device 10 across a floor or ground surface. A handle 23 can be secured to a side of the main body 12 for facilitating manual acceleration of the device in cooperation with the wheels 21. Further, a linen basket 25 can be secured to a side of the main body 12 for receiving clean or soiled linen.

With continuing reference to FIG. 2, it can be shown that an interior counter top 22 is mounted within the interior of the main body 12. A fixed sink 32 is fixedly mounted within an aperture of the counter top 22, and a movable sink 34 is removably positioned within an aperture of the counter top and can be extended therefrom as shown in FIG. 4. Further, a movable faucet 36 is similarly removably positioned within an aperture of the counter top 22 which can also be extended therefrom for remote placement relative to an individual. If desired, the present invention 10 may further comprise a horizontal panel 24 extending across the interior of the main body 12 and spaced beneath the counter top 22, and a vertical panel 26 bisecting a longitudinal length of the interior of the main body 12. The panels 24 and 26 cooperate to define a storage compartment 28, as well as to support water handling means 30 within the main body 12 for supplying water to the movable faucet 36 and for receiving waste water for storage from the sinks 32 and 34.

As best illustrated in FIGS. 2 through 4, it can be shown that the water handling means 30 according to the present invention 10 preferably comprises a fresh water tank 38 and a waste water tank 40 mounted within the main body 12. A battery powered demand pump 42 is positioned in fluid communication with the fresh water tank 38 for receiving fluid therefrom and maintaining a desired pressure within the water handling means 30. In other words, the demand pump preferably operates such that a drop in pressure within the water handling means 30 will cause the demand pump to automatically energize to maintain a desired minimum pressure within the water handling means 30. To this end, the demand pump may include a pressure sensor fluid communication with an output of the demand pump 42 which is in controlling electrical communication with an electric motor of the pump. If desired, a thermostatically controlled heater 44 can also be positioned into fluid communication with the demand pump so as to heat water being pumped therethrough to a desired temperature. Water pumped by the demand pump is received by a supply conduit 46 positioned into fluid communication with an output of the demand pump 42. The supply conduit 46 extends into communication with the movable faucet 36 such that water from the fresh water tank 38 is continuously supplied to the movable faucet for use during a shampooing or washing procedure. To handle waste water generated during use of the device 10, drain conduits 48 extends from the sinks 32 and 34 and into fluid communication with the waste water tank 40. By this structure, water can be dispensed by the movable faucet 36 into either of the sinks 32 and 34 during a washing procedure, whereby waste water will then gravitationally flow into the waste water tank 40. If desired, an additional and unillustrated waste water pump can be positioned into fluid communication with the drain conduits to create a vacuum or suction assisting in the disposal of the waste water into the waste water tank.

As shown in FIGS. 3 and 5, the water handling means 30 may further comprise a supply conduit reel 50 for storing the supply conduit when the same is unextended from the main body 12. Similarly, a drain conduit reel 52 can be included with the water handling means 30 of the invention 10 to store the drain conduit 48 coupled to the movable sink 34 during periods of non-extension thereof. As shown in FIG. 5 for the drain conduit reel 52 only, each of the conduit reels 50 and 52 is substantially similar in design and includes a spool 54 rotatably mounted upon an unillustrated axle secured within the main body 12. The drain conduit 48 extends through a center of the spool and through an unillustrated aperture therein to wind upon the spool 54. An unillustrated rotatable coupling, if desired, can be interposed between portions of the drain conduit 48 to permit ease of rotation of the spool 54 during winding of the drain conduit 48 thereonto. An unillustrated manual crank can extend from a rear of the main body 12 to permit manual reeling of the drain conduit 48 onto the spool 54. However, it is preferable that an unillustrated torsion or spiral spring be interposed between the spool and the axle supporting it so as to cause an automatic rewinding of the drain conduit 48 onto the spool. Suitable and unillustrated locking means of conventional configuration can be provided in combination with the spring for selectively locking the spool in a desired orientation so as to maintain a desired length of the drain conduit 48 off of the spool 54.

As shown in FIGS. 6 and 7, the movable sink 34 comprises a bottom wall 56 having a neck aperture 58 directed thereinto for accommodating a neck of an individual being shampooed or otherwise washed. A U-shaped side wall 60 extends around a portion of an outer periphery of the bottom wall and includes tapered forward portions 62 extending along laterally opposed sides of the neck aperture 58. The drain conduit 48 extends through the bottom wall 56 such that fluids within the movable sink can flow into the drain conduit for ultimate reception within the waste water tank 40. Preferably, the movable sink 34 is constructed of a substantially ductile, malleable, or deformable material permitting selective and non-resilient deformation of the movable sink 34 into a desired configuration. In other words,it is desirable for the material of the sink 34 to be deformable into a specific configuration, whereby such configuration is retained by the material. Examples of suitable materials include soft plastics, lead alloys, or other conventionally know ductile materials. By this structure, the movable sink can be placed behind a head of an individual residing within a bed and selectively deformed into a desired configuration so as to minimize water loss or escape of water from the movable sink 34. A washing procedure such as shampooing may then commence without a need for moving the patient from the bed.

Lastly, and as shown in FIG. 1, the linen basket 25 preferably comprises a U-shaped support bar 64 secured to the side of the main body 12. A mesh bag 66 is coupled to the U-shaped support bar 64 and depends downwardly therefrom for receiving objects such as linen.

In use, the portable washing cart 10 according to the present invention can be easily utilized for facilitating the washing or bathing and shampooing of an individual residing within a bed such as can be found within hospitals.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and descried in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A portable washing cart comprising:

a main body having a hollow interior;

an interior counter top mounted within the interior of the main body;

a movable sink removably positioned on the counter top which can be extended therefrom;

a movable faucet removably coupled to the counter top which can be extended therefrom;

water handling means mounted within the main body for supplying water to the movable faucet and for receiving waste water from the sink for storage, wherein the movable sink is constructed of a substantially ductile, malleable, and deformable material permitting selective and non-resilient deformation of the movable sink into a desired configuration.

2. The portable washing cart of claim 1, and further comprising a left front door pivotally mounted to a left vertical edge of the main body and a right front door pivotally mounted to a right vertical edge of the main body.

3. The portable washing cart of claim 2, and further comprising a left top door pivotally mounted to a left horizontal edge of the main body, and a right top door pivotally mounted to a right horizontal edge of the main body, wherein the top doors engage upper edges of the front doors when opened so as to be supported in a substantially horizontal orientation.

4. The portable washing cart of claim 3, and further comprising wheels rotatably mounted to the main body to facilitate rolling movement of the main body across a floor.

5. The portable washing cart of claim 1, wherein the water handling means comprises a fresh water tank and a waste water tank mounted within the main body; a supply conduit extending into fluid communication with the movable faucet; a battery powered demand pump positioned in fluid communication with the fresh water tank for receiving fluid therefrom and maintaining a desired pressure within the supply conduit; and a drain conduit extending into fluid communication with the movable sink and into fluid communication with the waste water tank.

6. The portable washing cart of claim 5, wherein the water handling means further comprises a thermostatically controlled heater positioned in fluid communication with the demand pump so as to heat water being pumped therethrough to a desired temperature.

7. The portable washing cart of claim 6, wherein the water handling means further comprises conduit reel means for storing the conduits in a compact configuration.

8. The portable washing cart of claim 7, wherein the conduit reel means comprises a supply conduit reel including a spool rotatably mounted within the main body, the supply conduit being wrapped about the spool of the supply conduit reel; and a drain conduit reel including a spool rotatably mounted within the main body, the drain conduit being wrapped about the spool of the drain conduit reel.

9. The portable washing cart of claim 8, wherein the movable sink comprises a bottom wall having a neck aperture directed thereinto for accommodating a neck of an individual; and a U-shaped side wall extending around a portion of an outer periphery of the bottom wall, with the drain conduit extending through the bottom wall such that fluids within the movable sink can flow into the drain conduit.

10. The portable washing cart of claim 9, wherein the U-shaped side wall includes tapered forward portions extending along laterally opposed sides of the neck aperture.

11. The portable washing cart of claim 5, wherein the water handling means further comprises a fixed sink fixedly mounted to the counter top and positioned in fluid communication with the drain conduit.

* * * * *